United States Patent [19]

Mason et al.

[11] Patent Number: 4,499,561

[45] Date of Patent: Feb. 12, 1985

[54] APPARATUS FOR CONTINUOUSLY PRODUCING A DRY MATERIAL AND LIQUID SLURRY

[75] Inventors: Walter R. Mason, Cincinnati; Jimmie L. Cummings, Winchester, both of Ohio

[73] Assignee: Hoge, Warren, Zimmerman Company, Cincinnati, Ohio

[21] Appl. No.: 447,491

[22] Filed: Dec. 6, 1982

[51] Int. Cl.[3] ..... B01F 15/02

[52] U.S. Cl. ..... 366/156; 366/165

[58] Field of Search ..... 366/156, 152, 158, 155, 366/160, 161, 165, 167, 173, 341, 9, 150, 154, 155

[56] References Cited

U.S. PATENT DOCUMENTS

| | | | |
|---|---|---|---|
| 1,790,347 | 1/1931 | Hawkins | 366/165 |
| 2,768,559 | 10/1956 | Krogel | 366/167 |
| 2,906,607 | 9/1959 | Jamison | 366/165 |
| 3,006,615 | 10/1961 | Mason | 366/20 |
| 3,425,669 | 2/1969 | Gaddis | 366/153 |

*Primary Examiner*—Robert W. Jenkins
*Attorney, Agent, or Firm*—Kinney and Schenk

[57] ABSTRACT

An apparatus and method for producing a slurry of dry metered plaster and metered water on a continuous basis. The apparatus consists of an element functioning to receive dry metered plaster and to agitate this plaster before discharging it downward from a discharge aperture. An additional device receives metered water and causes it to eject in such manner as to surround and encompass the discharging dry plaster in sheets or sprays of water. A receptacle element is disposed to receive the plaster and water and is so configured that the commingling mixture will descend along the side of the receptacle into an aperture at the base. Additionally a progressive cavity pump is disposed in juxtaposition and communicating with the receptacle aperture so that the commingling mixture will draw into the pump. Upon passing through the pump the mixture is transformed into a homogeneous slurry and is propelled through a conduit to the point of use.

25 Claims, 11 Drawing Figures

APPARATUS FOR CONTINUOUSLY PRODUCING A DRY MATERIAL AND LIQUID SLURRY

BACKGROUND OF THE INVENTION

1. Field of the Invention

The present invention relates to a method and system for continuously providing a dry material and liquid slurry. For example, a plaster and water slurry used in the production of plaster molds in the ceramics industry.

2. Description of the Prior Art

Presently in use in the various industries utilizing plaster molds is the apparatus and method disclosed by U.S. Pat. No. 3,006,615. This U.S. Patent disclosed an apparatus which provides for mechanical mixing of metered dry plaster and metered water in a mixing chamber to form a continuous slurry. The slurry, thus formed, is pumped by a slurry pump to the place where the slurry is poured into case molds, flasks or the like and when hardened the slurry forms plaster molds.

However, lengthy experience with the equipment, as disclosed in U.S. Pat. No. 3,006,615, indicates certain problems have arisen in specific situations. The principle problem appears to reside with the step of mechanical mixing as disclosed by U.S. Pat. No. 3,006,615. The mechanical mixing appears to produce slurry exhibiting undesirable characteristics when said slurry is formed into plaster molds used in ceramic casting for the hobby mold industry and for the ceramic tableware or china dinnerware industry.

After study it has been concluded that the mechanical means used to mix the dry plaster and water into a slurry causes the mixture to harden on the mixing element and on the surfaces of the mixing chamber and that a certain scraping of the surfaces of such set plaster inevitably occurs. It is this scraping and grinding action which strews hardened plaster particles (known as terra alba) into the plaster slurry being generated and causes a deleterious effect in the crystalline structure of the resulting plaster molds.

In order for one to appreciate the significance of terra alba in the slurry it will be necessary to give a brief description of the chemical structure of gypsum which is the basic substance of plaster. Gypsum chemically is calcium sulfate and when it is in the dry powdered state as received by a mold shop it is in a form known as hemi-hydrate or $CaSO_4.\frac{1}{2}H_2O$. This is the uncrystallized gypsum as it exists following calcining in the gypsum production mill—one half molecule of water exists in chemical combination with the $CaSO_4$. When additional mixing water and hemi-hydrate gypsum are brought together another one and one half molecules of water begin to combine with the hemi-hydrate to produce $CaSO_4$—$2H_2O$ designated as gypsum dihydrate. At this point the gypsum has solidified into crystals. Although there is excess water present beyond that needed for the chemical reaction, such excess water remaining in the molds is normally dried off in air circulation rooms or in heat driers.

There are in the setting of plaster (the formation of gypsum crystals $CaSO_4.2H_2O$) many factors to consider but one in particular is pertinent to the disclosure of this invention. That factor is mechanical mixing of the plaster slurry and its effect on crystal formation. Crystallography photo micrographs reveal that gypsum crystals in molds produced by a continuous mixer as disclosed in U.S. Pat. No. 3,006,615 are on average less randomly oriented and more frequently broader and shorter and more uniformly distributed than in molds produced by the conventional batch method of stirring such slurry in a pail. The effect of rapid mechanical mixing which a continuous production system entails, creates the particles of terra alba previously described and it is well known in the art that terra alba is an accelerator for setting plaster. What occurs is that the terra alba seeds the crystal growth in the plaster slurry causing the crystals to grow fast and early. Subsequently attrition of these crystals by additional mixing breaks them down so that the final result is a relatively uniform matrix of gypsum crystals having few random large crystal clumps or excrescenses. In the molds used by the ceramic industry this can be of significant importance because a high degree of mold absorption is important for good casting and randomly oriented, non-uniform crystals yield molds of greater relative absorption, while more uniform crystals more evenly dispersed, yield molds of lesser absorption. Obviously any continuous mixing apparatus which utilizes a high speed mixing element and a mixing chamber to produce a plaster slurry will always exhibit the aforementioned terra alba effect, albeit in greater or lesser degree depending on how much terra alba is strewn into the slurry. Especially at a very low throughput of slurry through the mixing chamber (where an essentially constant quantity of terra alba is being generated) there will be a pronounced effect in the crystalline structure and consequently reduced absorbency of the resultant molds.

In the ceramic industry hobby molds and molds used for china tableware are relatively small. In consequence their production requires a relatively low throughput of plaster slurry and inasmuch as the terra alba effect is greatest when the throughput is lowest the result in these industries has been widespread lack of success with continuous mixing.

SUMMARY OF THE INVENTION

The present invention embodies means for producing a plaster water slurry on a continuous basis while essentially avoiding the step of mechanical mixing and consequently the afore described terra alba effect.

Accordingly it is an object of this invention to produce continuously, a plaster water slurry essentially free from set plaster particles ($CaSO_4.2H_2O$) known as terra alba.

It is a further object of this invention to provide a method and apparatus which will produce plaster water slurry without the step of mechanical mixing.

It is a further object to provide an apparatus which is simplified by the elimination of the physical elements involved in the step of mechanical mixing.

It is a further object to make easier the cleaning of the apparatus of the invention which has been simplified by the elimination of the mechanical mixing.

It is a further object of this invention to produce continuously a plaster water slurry which yields molds having a relatively randomly oriented crystalline structure.

It is a further object of this invention to produce a plaster water slurry which yields molds having relatively high permeability.

It is a further object of this invention to produce a plaster water slurry on a continuous basis in order to supplant the batch system of mixing slurry in pails or buckets as currently practiced in many sectors of the ceramic industry.

It is still a further object of apparatus of this invention to permit an operator to simultaneously collect metered dry plaster and metered water on a time interval basis and to weigh these samples to determine the precise plaster water ratio in the slurry produced.

Further objects and advantages of this invention will become apparent from the following description of the preferred embodiment, the claims, and the attached drawings.

DETAILED DESCRIPTION OF THE PREFERRED EMBODIMENT

Figures 1, 3, 6, 7, 8:
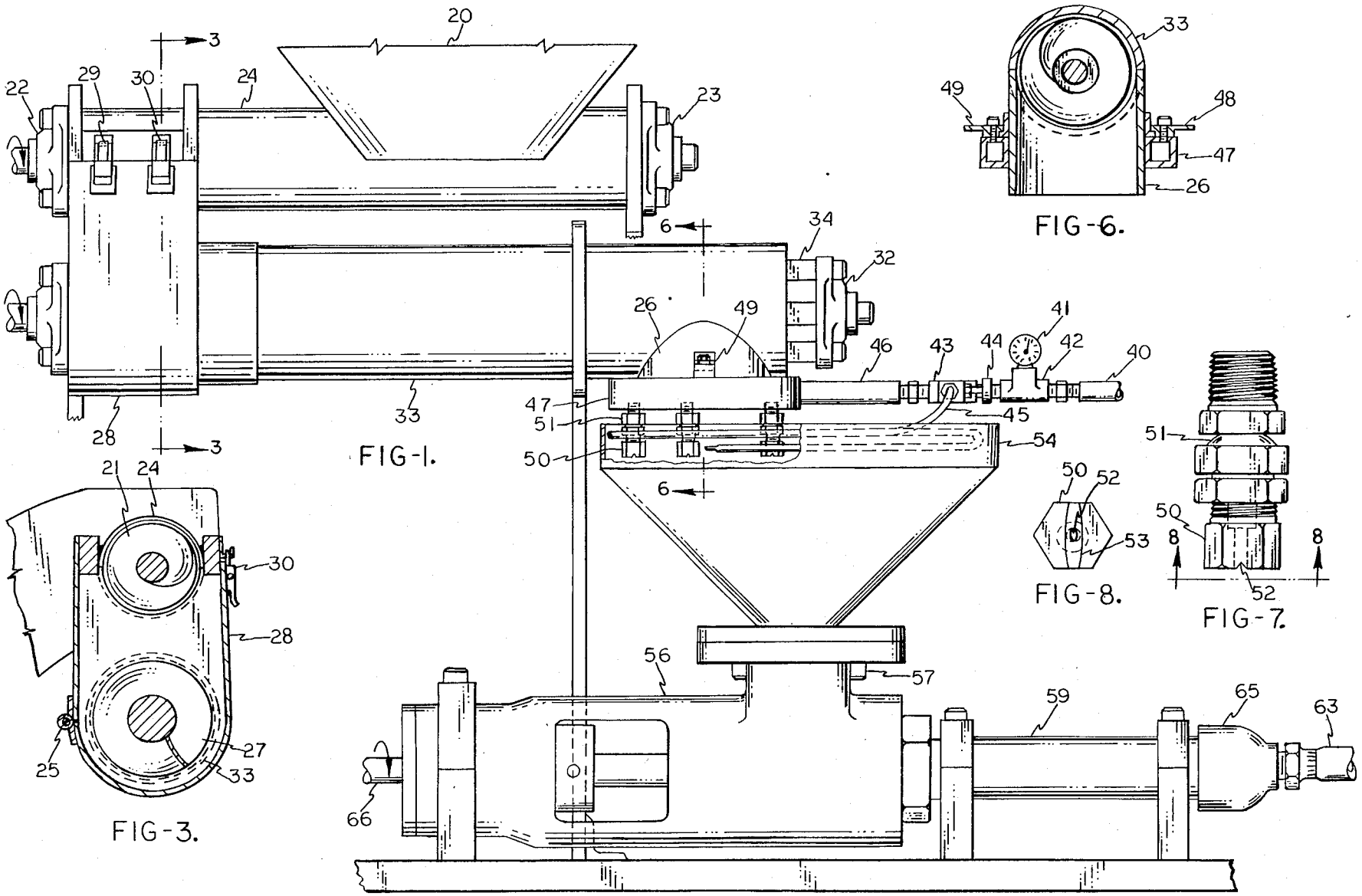
FIG. 1 is a frontal elevation of the system of the invention.
FIG. 3 is a section taken on the line 3—3 of FIG. 1.
FIG. 6 is a section taken on the line 6—6 of FIG. 1.
FIG. 7 is a side elevation of a spray nozzle mounted on a ball joint swivel also shown in FIGS. 1, 2, 5.
FIG. 8 is an end view 8—8 of the spray nozzle FIG. 7.

The following description will be directed in particular to elements performing part of, or cooperating more directly with, the present invention. Elements not specifically shown or described herein are understood selected from those known in the art.

In the practice of the invention there is provided an accumulated amount of dry plaster which is continuously metered and delivered to a transfer means, said transfer means being arranged to agitate said dry plaster and propel it to a discharge aperture. There is also provided in the practice of this invention a continuous supply of metered water under pressure sufficient to force it through the various conduits and orifices of the system. The dry plaster as it reaches the discharge aperture discharges downward into a receiving hopper, the aperture being encircled by an annular passage containing the continuously metered water. The water is constrained to exit downward also and to generally surround or enclose the dry plaster in a curtain-like spray or sheet of water, thereby concentrating the water and dry plaster into a confined portion of the hopper. Such concentration of water and plastic causes them to mingle and the resulting mass or sludge to descend along the side of the hopper to the bottom. At or near the bottom is provided an entry communicating with a progressive cavity pump, said pump being disposed beneath or adjacent to the slurry hopper. The pump is provided with sufficient suction to draw the mass of commingled dry plaster and water into the entry port of the pump. The invention relies on this system together with the turbulent mixing action imparted by the progressive cavity pump to produce a homogenous slurry upon exit from the conduit delivering the slurry from the pump to the point of use.

A major challenge to which this invention is addressed resides in the evident difficulty of providing means for generating a blend of water and plaster such that the blend will descend a receptacle hopper wall and enter the inlet port of a progressive cavity pump. Special plasters known as pottery plasters are used in making the plaster molds used for manufacturing ceramics and these plasters are generally specified to have a ratio of plaster to mixing water of between 65 to 75 parts by weight water to 100 parts by weight plaster. In these proportions the water and dry plaster upon being brought together will not readily form a slurry but rather a thick sludge and until this has been reduced by some degree of mixing it will not behave as a pourable slurry. If the sludge is to be reduced rapidly to a slurry, the mixing must be intense as in the apparatus of U.S. Pat. No. 3,006,615 where reduction takes place in one to two seconds. The simultaneous introduction of dry plaster and water into a receptacle hopper must be accomplished in such manner as to overcome the tendency for the dry plaster to absorb the water instantly and to form a sludge too viscous to dislodge from the hopper surface. It is to meet and overcome this inherent propensity of the plaster to adhere to any surface, however smooth, that the specific apparatus and method of the invention has been developed.

Figures 2, 10, 11:
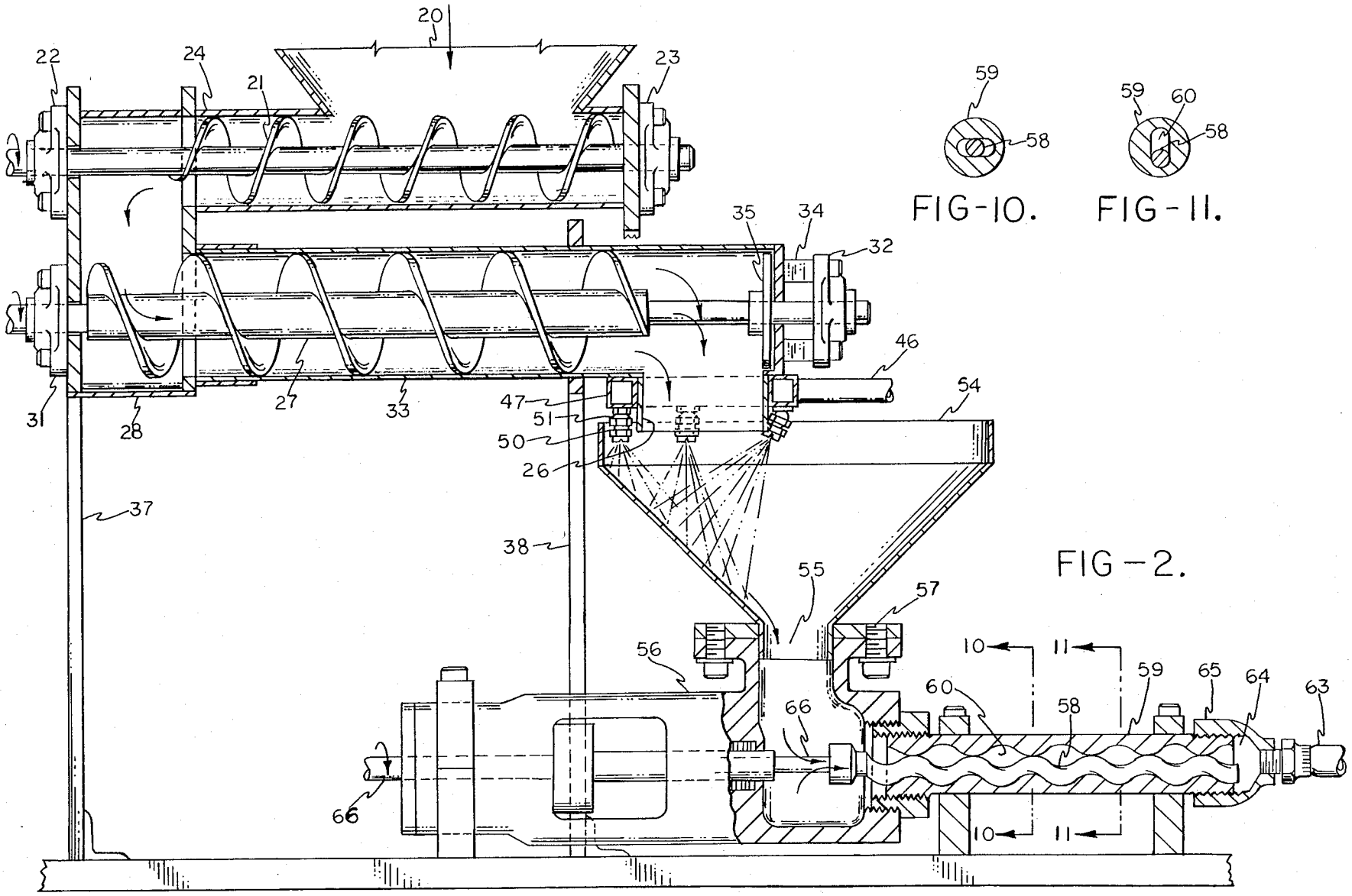
FIG. 2 is also a frontal elevation of the system partly in section and partly in breakaway.
FIG. 10 is a section taken on the line 10—10 through the progressive cavity pump FIG. 2.
FIG. 11 is another section taken on the line 11—11 through the progressive cavity pump FIG. 2.

To explain this invention in greater detail it is necessary to refer in a specific way to the drawings composed of the various figures. There is provided, as shown in FIG. 1 and FIG. 2, a supply hopper 20 for dry plaster communicating with means to meter said dry plaster. Said means might consist of screw conveyor 21 journaled at opposite ends in bearings 22 and 23 and passing through tubular passage 24. Rotation of said screw conveyor (driving means not shown) results in volumetric metering of the dry plaster which is conveyed from right to left into tubular passage 24 and which discharges at the point where the flights of screw conveyor 21 end. Communicating in turn with passage 24 is means to receive the metered plaster and to propel it to aperture 26. Said means is here shown as screw conveyor 27 of larger diameter than screw conveyor 21 and positioned parallel to and below screw conveyor 21. The manner in which dry plaster is delivered from the metering screw conveyor 21 to screw conveyor 27 is readily understood by referring to FIG. 3 which depicts the two screw conveyors in positional relationship as seen beneath the cover door 28. This removable cover door latches in front with latches 29 and 30 and hinges in the back with hinge 25. Dry plaster falls by gravity from metering screw conveyor 21 and is received and conveyed in a reverse direction by transfer screw conveyor 27. Said conveyor is journaled at one end in bearing 31 and at the opposite end in bearing 32, said bearing 32 being mounted outboard of housing tube 33 and spacers 34. Thus protection is afforded the bearing from immediate contact with dry plaster. Further protection is provided by circular slinger 35 mounted on the shaft of screw conveyor 27. The slinger serves to prevent dry plaster from exiting from tube 33 along this shaft.

Inasmuch as screw conveyor 27 is driven (driving means not shown) at a speed faster than screw conveyor 21—on the order of 50% to 100% faster—it not only receives and transports all of the dry plaster reaching it, but also agitates said material by a centrifugal flinging action of the conveyor flights. Therefore the dry plaster swirls and spirals along the length of tubular passage 33 until it reaches and exits from discharge opening 26.

The structure embodying the elements of the invention so far here described is supported generally by frame supports as indicated by 37 and 38.

The purpose in agitating the dry plaster before it is discharged from aperture 26 is to aerate it and to break up any compaction existing so that the emerging plaster is loose and fluffed and can readily commingle with the metered water which joins it. Said metered water (method of metering not shown) enters the system at hose 40 under moderate pressure—on the order of 1 to 5 p.s.i.—which pressure may be monitored on pressure gauge 41 mounted on tee 42.

Figure 4:
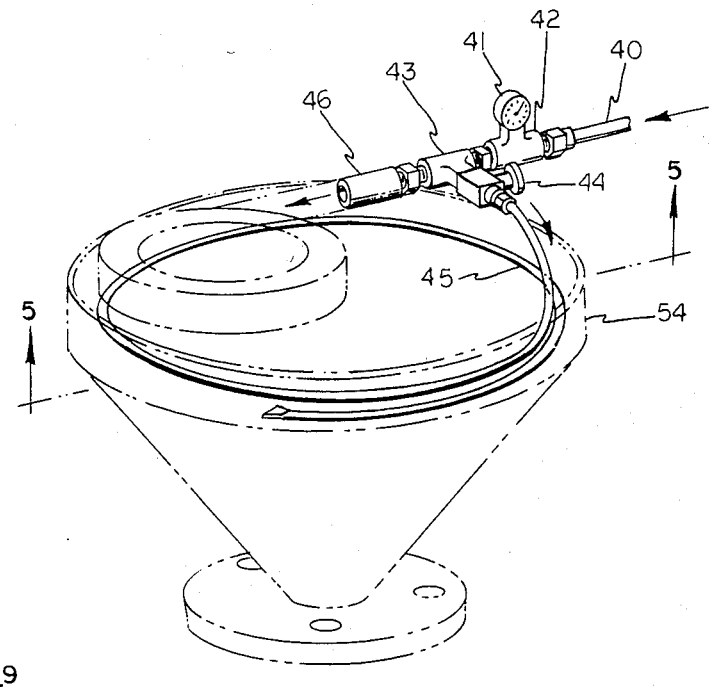
FIG. 4 is an isometric drawing showing the general water introduction system.
Figure 5:
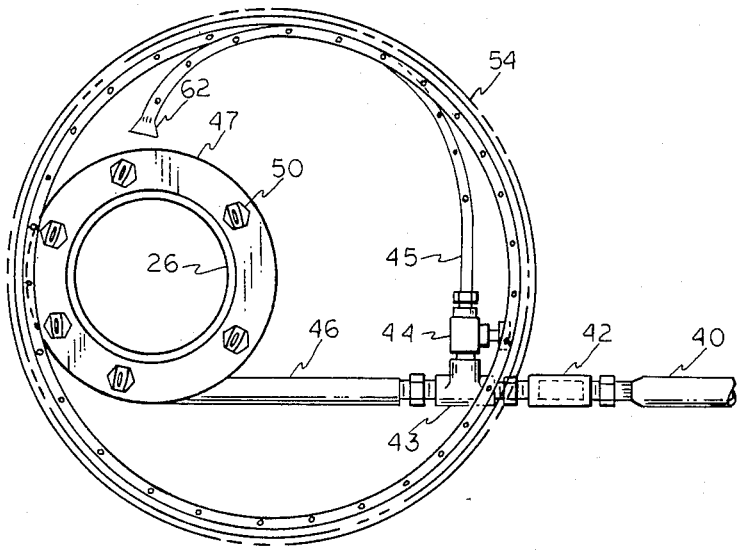
FIG. 5 is a section taken on the line 5—5 of FIG. 4.

The metered water system is shown in FIGS. 4 and 5 where it is seen that tee 42 is adjacent to tee 43 to which is joined metering valve 44. The purpose of metering valve 44 is to divert a portion of the metered water through tube 45 as will be explained at a later point.

The greater portion of the metered water flows into conduit 46 and thence into the annular opening within ring 47. Normally 80% of more of the metered water will enter the ring. As shown in FIG. 6 the hollow ring 47 encircles the discharge opening 26 and is fastened in position by latches 48 and 49. Mounted into ring 47 so as to communicate with the annular opening are spray heads 50 (FIG. 7) set in ball swivel mounts 51. Thus the angle of spray is separately deflectable for each spray head. As shown in FIG. 2 the dry plaster discharges within the inner circumference of ring 47 which ring incorporates a series of said spray heads 50 circularly arranged as generally indicated in FIG. 5. Turning to FIG. 7 each spray is designed to eject a thin flat sheet of water of characteristics determined by the shape of orifice 52 which is in turn determined by the dimentions of groove 53 shown in FIG. 8. Typically the spray fans out at a 30 degree to 70 degree angle.

Dry plaster and sprayed water enter conical hopper 54 in such manner that the water encompasses the dry plaster circumferentially and confines it to a limited area within the hopper. The sprayed water is so directed as to sweep partly beneath the plaster so that rather than impinging on the surface of the conical hopper directly, the dry plaster descends upon a flowing sheet or blanket of water and thus courses to the bottom of the hopper. It is of critical importance that none of the dry plaster adhere to the surface of the hopper because any spot of such adherence can rapidly enlarge until a sizable mound of hanging plaster exists.

At the lowest point of hopper 54 is opening 55 communicating with the inlet port of progressive cavity pump 56 to which said hopper is bolted by bolts 57. As the metered water and plaster join and commingle within hopper 54, the resulting mass continuously courses downward through opening 55 into the pump. Upon entering said pump, it is drawn into the cavities 60 formed by the rotation of rotor 58 within stator 59. As stipulated in this invention the rotation of rotor 58 must equal or exceed 155 r.p.m. to produce the required homogenous slurry of plaster and water after said slurry has passed through the pump and two or more meters of conduit 63.

Figure 9:
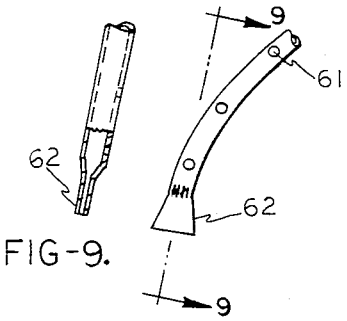
FIG. 9 is a section taken on the line 9—9 of FIG. 5.

Returning now to the quantity of water which is diverted through tee 43 and metering valve 44 into tube 45, it is shown in FIG. 4 and FIG. 5 that the tube encircles the hopper on the inside and that the tube is perforated with small holes 61 along its length on the underside. The purpose of these holes is to allow rivulets of water to trickle down the inner walls of hopper 54 around its perimeter from the top down in order to keep plaster dust from settling on the hopper sides and thus building up a plaster crust. The tube 45 as shown encircles the hopper approximately one and one quarter times. This permits the end of the tube to be positioned at a specific point close to the water ring. The end of the tube FIG. 9 is flattened 62 so that a fan spray of water can be emitted and directed at any desired place beneath the water spray heads. This arrangement constitutes a fine adjustment remedy by means of which any spot which appears susceptible to adherence of the plaster to the hopper wall, can be precisely treated with a water spray.

Turning back to the means by which the plaster and water are formed into a slurry, a description of a progressive cavity pump is in order. This type pump is originally an invention of the French inventor R. V. Morineau and although the manufacturers of the pumps in the USA have advertised the pump as one in which "continuous straight line action delivers uniform quantities (of the material being pumped) without turbulence agitation or pulsation", this has been found not to be true, not only in the practice of U.S. Pat. No. 3,006,615 but additionally in experimentation by the present inventors. On the contrary, as the speed of the pump has been increased above a certain range of speed, enormous tubulence occurs in cavity 64 which is inside the bell shaped cap 65 threaded to the stator 59. Were this cap removed and the pump operated at a speed in excess of 155 r.p.m., the plaster slurry would be thrown outward in a continuous cone shaped sheet which pulsated with each rotation of the rotor 58. When the cap is replaced, all of the slurry spray is confined in a very small cavity and the result of the slurry rebounding upon itself with great force is extreme turbulence and therefore substantial mixing.

It will be noted that a progressive cavity pump is uniquely suitable for the requirements of the invention namely that essentially no mechanical mixing be applied to the plaster slurry as it is generated. Referring to FIG. 2 it will be observed that as the plaster-water blend leaves the hopper 54 and enters the inlet cavity of the progressive cavity pump 56; it encounters no element to impart mechanical mixing except drive shaft 66 which drives the rotor 58. This is a smooth shaft whose rotation imparts minimal mechanical mixing to the plaster-water mixture being sucked into the rotor-stator cavities 60. The rotor 58 is a steel member, very smooth and double or triple plated with chromium. The stator 59 is a pipe or tube lined with smooth natural rubber or neoprene of 45 to 60 durometer hardness. It is contoured to fit the appropriate rotor so that as rotation of the rotor proceeds a double line of contact always exists between the surface of the rotor and the interior surface of the stator as shown in FIG. 10 and FIG. 11. Rotation of the rotor results in a rolling of the lines of contact between rotor and stator and a progression of the pump cavities toward the outlet port of the pump. There is again in this pumping action a minimum of mechanical mixing (which is by definition a matter of mechanical shearing of the material being mixed) and so as previously stated the progressive cavity pump is uniquely suitable for the requirements of this invention.

Present inventors have found that the speed of rotation of rotor 58 must equal or exceed 155 r.p.m. for sufficient turbulent mixing to occur to produce a homogenous plaster water slurry after said slurry has passed through the pump and at least two meters of conduit 63. The rotational speed of pump 56 is variable by means of variable speed driving means (not shown) applied to shaft 66. The speed of said pump must be adjusted to accommodate as exactly as possible the quantity of material being generated and entering the inlet port of the pump since otherwise the material will either back up in the hopper if the pump is too slow or if the pump is too fast it will draw in excessive air along with the plaster slurry. Thus in the practice of this invention there is a necessity to select the progressive cavity pump by size according to the quantity output of material desired in the particular application. Doing this assures that the selected pump will rotate at 155 r.p.m. or faster in order to accommodate said output of slurry. The pump must not be of such size that it can accommodate the desired slurry output at a lesser speed.

While a particular embodiment has been illustrated and described, it will be obvious to those skilled in the art that various changes and modifications may be made without departing from the invention and it is intended to cover in the appended claims all such changes and modifications that fall within the true spirit and scope of the invention.

What is claimed is:

1. Apparatus for continuously generating a slurry of metered dry hemi-hydrate gypsum and metered water comprising:

means for simultaneously agitating and propelling said metered dry hemi-hydrate gypsum to a removed location;

means for discharging said metered dry gypsum downward into a receptacle means;

means for generally enclosing and confining said discharging gypsum within a sheet or spray of said metered water, whereby said gypsum and said metered water are commingled;

means for converging said commingled hemi-hydrate gypsum and said metered water toward the base of said receptacle;

means for turbulent mixing, said means being in communication with said base of said receptacle means; and conduit means of at least two meters length communicating with said means for turbulent mixing.

2. Apparatus as recited in claim 1 wherein said hemi-hydrate gypsum is a plaster used in the manufacture of ceramics.

3. Apparatus as recited in claim 1 wherein said means for simultaneously agitating and propelling said hemi-hydrate gypsum to a removed location further comprising:

a screw conveyor operating in a housing, said screw conveyor rotating at a speed sufficient to fling said metered gypsum radially outward by centrifugal force.

4. Apparatus of claim 3 wherein said screw conveyor has capacity to propel a greater quantity of metered hemi-hydrate gypsum than the quantity delivered to it.

5. Apparatus as recited in claim 1 wherein said means for discharging said gypsum downward into a means for receiving further comprising:

a screw conveyor operating a housing, said housing having an aperture positioned offset from center over a means for receiving.

6. Apparatus of claim 5 wherein said aperture positioned offset from center over a receiving hopper is disposed so that none of said hemi-hydrate gypsum descends directly into the base of said receiving hopper.

7. Apparatus of claim 5 wherein the width of said aperture is one half or less of the greatest width of said receiving hopper.

8. Apparatus as recited in claim 1 wherein said means to generally enclose and confine said discharging hemi-hydrate gypsum within said sheet or spray of metered water consists of three or more spray heads.

9. Apparatus as recited in claim 8 wherein said spray heads are circumferentially disposed with respect to said aperture.

10. Apparatus as recited in claim 9 wherein said spray heads communicate with an annular passage encircling said aperture and conducting said metered water.

11. Apparatus of claim 8 wherein said spray heads are mounted in swivel mounts for deflectability.

12. Apparatus of claim 1 wherein said means to cause said metered gypsum and said metered water to converge toward the base of said receptacle means consists of a generally conically shaped hopper so positioned that delivery of said metered gypsum and said metered water takes place upon a sloping side of said hopper.

13. Apparatus of claim 1 wherein said turbulent mixing means in communication with said base of said receptacle means consists of a progressive cavity pump communicating with the base of a generally conical hopper.

14. Apparatus of claim 13 wherein said progressive cavity pump is driven at a speed of at least 155 r.p.m.

15. Apparatus of claim 1 wherein said conduit means of at least two meters length communicating with said turbulent mixing means consists of a hose or tubing attached to a progressive cavity pump.

16. Apparatus of claim 1 where not more than 30% of said metered water is diverted into tubular means generally encircling said receptacle means and emitting said water to wash or bathe the surfaces of said receptacle means.

17. A method for producing a continuous slurry of hemi-hydrate gypsum and water which comprises the steps of:

accumulating hemi-hydrate gypsum in a storage apparatus, continuously metering said hemi-hydrate gypsum, agitating and conveying said metered hemi-hydrate gypsum to a discharge aperture, continuously metering water in a fixed proportion to said metered hemi-hydrate gypsum, continuously delivering said metered hemi-hydrate gypsum from said discharge aperture by gravity into a collection chamber and simultaneously delivering said metered water into said chamber in such a manner that said hemi-hydrate gypsum and said water commingle, said commingling being effected with no mechanical handling or mixing, the resulting blend or sludge descending by gravity into said chamber and reaching an aperture communicating with a turbulent pumping apparatus, continuously transferring said commingled gypsum and said metered water through said aperture to said turbulent pumping apparatus and continuously forming a homogenous slurry within said turbulent pumping apparatus and propelling said slurry through a conduit to the point of use.

18. A method as recited in claim 17 wherein said hemi-hydrate gypsum is a plaster used in making molds for the manufacture of ceramics.

19. A method as recited in claim 17 wherein said plaster is specified to have a consistency (water plaster ratio) of between 65 and 75.

20. A method as recited in claim 17 wherein said turbulent mixing apparatus is a progressive cavity pump communicating with a conduit to convey said slurry to the point of use.

21. Apparatus for continuously producing a slurry of metered hemi-hydrate gypsum and metered water comprising:

a storage hopper;

a metering screw conveyor communicating with said storage hopper;

a second delivery screw conveyor operating in a housing and communicating with said metering screw conveyor, and second screw conveyor disposed to receive the total of said metered gypsum and said second screw conveyor having greater capacity than said metering screw conveyor, also said second delivery screw conveyor rotating at a speed sufficient to cause agitation in said metered gypsum;

a discharge aperture in said housing containing said second screw conveyor;

a receptacle hopper disposed beneath said discharge aperture, said receptacle hopper positioned off center from said aperture;

a water injection system communicating with said metered water, said injection system encircling said discharge aperture, and disposed to eject said metered water so as to generally surround and confine said metered gypsum emerging from said discharge aperture;

a converging configuration to said receptacle hopper causing said metered gypsum and said metered water to descend upon a sloping side of said receptacle hopper and to commingle and to course into the base of said hopper;

an aperture in said base of said receptacle hopper;

a progressive cavity pump communicating with said aperture, said progressive cavity pump rotating at a speed just sufficient to receive the totality of said metered gypsum and said metered water, and said pump rotating at least 155 r.p.m.;

a conduit communicating with said progressive cavity pump, said conduit having a length of at least two meters.

22. The apparatus of claim 21 wherein not more than 30% of said metered water is diverted into a generally circular conduit, said conduit disposed inside said receptacle hopper near the top, said conduit being perforated with numerous openings along its length on the underside.

23. The apparatus of claim 21 wherein said metered hemi-hydrate gypsum is pottery plaster used in the making of plaster molds for the ceramics industry.

24. The apparatus of claim 21 wherein said receptacle hopper is generally conically shaped and so disposed that none of said metered gypsum nor said metered water falls directly into said aperture in said hopper base.

25. Apparatus for continuously generating a slurry of metered dry hemi-hydrate gypsum and metered liquids, said apparatus comprising:

means for simultaneously agitating and propelling said metered dry hemi-hydrate gypsum to a removed location;

means for discharging said metered dry gypsum downward into a receiving means;

means for enclosing and confining said discharging gypsum within a sheet or spray of said metered liquid, said means having at least three spray heads circumferentially disposed with respect to said means for discharging and communicating with an annular passage conducting said metered water and encircling said means for discharging;

means for turbulent mixing, said means being in communication with the base of said receiving means; and conduit means, at least two meters long, communicating with said means for turbulent mixing.

* * * * *